US006299732B1

(12) United States Patent
Rekilä

(10) Patent No.: US 6,299,732 B1
(45) Date of Patent: Oct. 9, 2001

(54) DOCTOR BEAM FITTED IN CONNECTION WITH A ROLL OR A CYLINDER IN A PAPER MACHINE OR A BOARD MACHINE

(75) Inventor: Ilkka Rekilä , Uurainen (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/425,708

(22) Filed: Oct. 22, 1999

(30) Foreign Application Priority Data

Oct. 22, 1998 (FI) ..... 980464 U

(51) Int. Cl.[7] ..... D21G 3/00

(52) U.S. Cl. ..... 162/272; 162/281; 15/256.51; 15/256.53

(58) Field of Search ..... 162/111, 198, 162/199, 272, 281; 15/256.51, 256.53; 101/120, 157, 169, 350.6; 118/100, 107, 110, 119, 126, 261; 210/396; 399/284; 427/356; D25/122, 126

(56) References Cited

U.S. PATENT DOCUMENTS 5,356,519 * 10/1994 Grabscheid et al. ..... 162/281
6,036,818 * 3/2000 Odmark ..... 162/261

FOREIGN PATENT DOCUMENTS 40 25 106-A1 * 2/1992 (DE) ..... D21G/3/02

* cited by examiner

*Primary Examiner*—Peter Chin
*Assistant Examiner*—Eric Hug
(74) *Attorney, Agent, or Firm*—Steinberg & Raskin, P.C.

(57) ABSTRACT

A doctor beam for mounting a doctor to a roll or cylinder in a paper or board machine. The doctor beam including a shaped face having a curvature that conforms to the curvature of the roll or cylinder being doctored.

7 Claims, 2 Drawing Sheets

DOCTOR BEAM FITTED IN CONNECTION WITH A ROLL OR A CYLINDER IN A PAPER MACHINE OR A BOARD MACHINE

FIELD OF THE INVENTION

The present invention relates to a doctor beam coupled with a roll or cylinder in a paper, and, more particularly, to a doctor beam having a novel cross section construction

BACKGROUND OF THE INVENTION

Paper machines and board machines employ rollers and cylinders over which the web passes during operation of the machine. In order to operate efficiently these roller must remain free from debris. Doctor devices, a.k.a. doctors, are typically employed to clean any debris that may become lodged to the rollers or cylinders. Doctors include a blade which is pressed against the roller or cylinder which serves to scrape and remove debris therefrom.

Typically, doctors are secured to a corresponding roller by a doctor beam which consists of a steel beam having a triangular cross section. These beams are typically large, bulky structures requiring a great deal of space. As a consequence, conventional beams are heavy and consume large amounts of space in a paper or board machine which that may include many rollers and doctors. This necessitates large factories, resuming in increased manufacturing costs.

OBJECTS AND SUMMARY OF THE INVENTION

Accordingly, it is an object of the present invention to provide an improved doctor beam for securing a doctor to a roll or cylinder of a paper machine.

It is another object of the present invention to provide an improved doctor beam structure which overcomes the disadvantages and shortcomings of the prior art.

It is a further object of the present invention to provide a doctor beam structure which consumes less space than conventional and thereby reduces associated manufacturing costs.

In accordance with the objects of the invention, a doctor beam is provided having a cross-section with a triangular point structure, each of the points of the triangular point structure being interconnected by curved face portions. Thus, the doctor beam according to the present invention includes concave walls. The curvature of the walls is selected according to the curvature of the adjacent roll or cylinder face to be maintained by the doctor. This enables the doctor beam to consume less space than conventional doctor beans as the doctor beam in accordance with the invention may be placed in close proximity to the roll or cylinder without interfering with the same. This feature is particularly advantageous in high speed modem paper or board machines which employ multiple rolls arranged in side by side relationship. In such conditions, conventional rolls can not be employed because that can not be accommodated within the interstitial spaces between rolls.

Thus, the doctor beam structure according to the present invention bas at least one face portion having a curved shape, the curvature of the face substantially corresponding to the curvature of the face of the roll mantle of the adjacent roll. As several of the faces of the doctor beam may be curved in this fashion, the doctor beam is particularly suitable for placement in a dryer section of a paper or board machine between two adjacent cylinders, where space is often too confined for a beam of conventional construction.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE INVENTION

Figure 1:
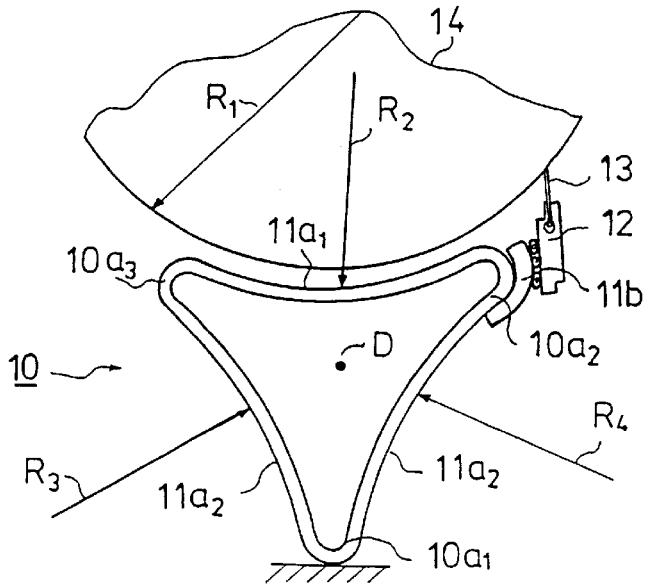
FIG. 1 is a cross-sectional view of a doctor beam according to the present invention in connection with a roll of a paper/board machine.
Figure 3:
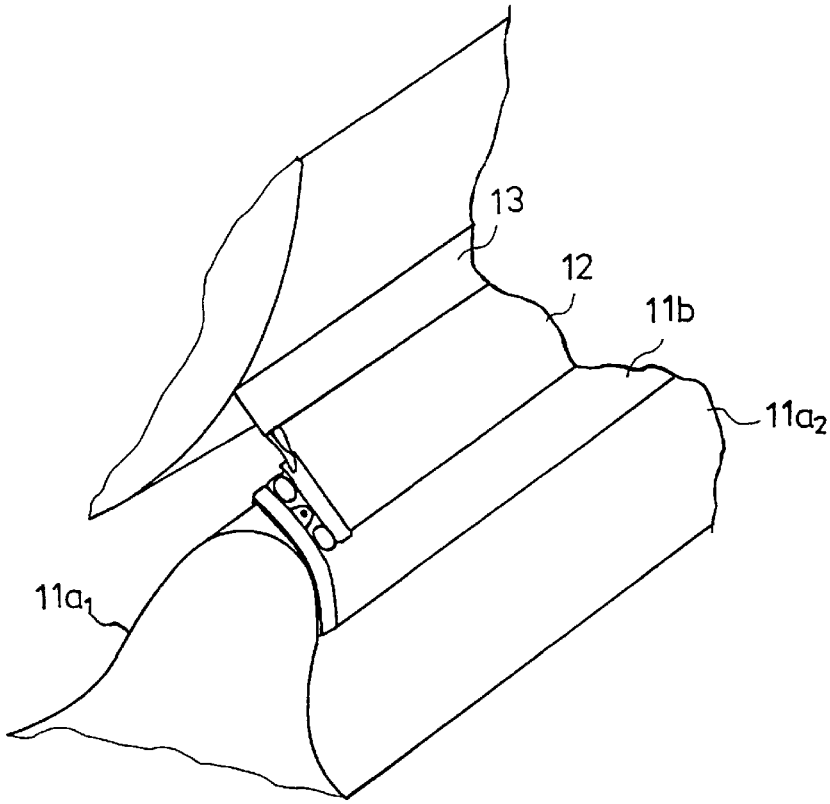
FIG. 3 shows an embodiment of the doctor beam according to the present invention in which a doctor blade holder is connected to a separate rib, the rib being attached at one end to the curved wall structure of the doctor beam.
Figure 2:
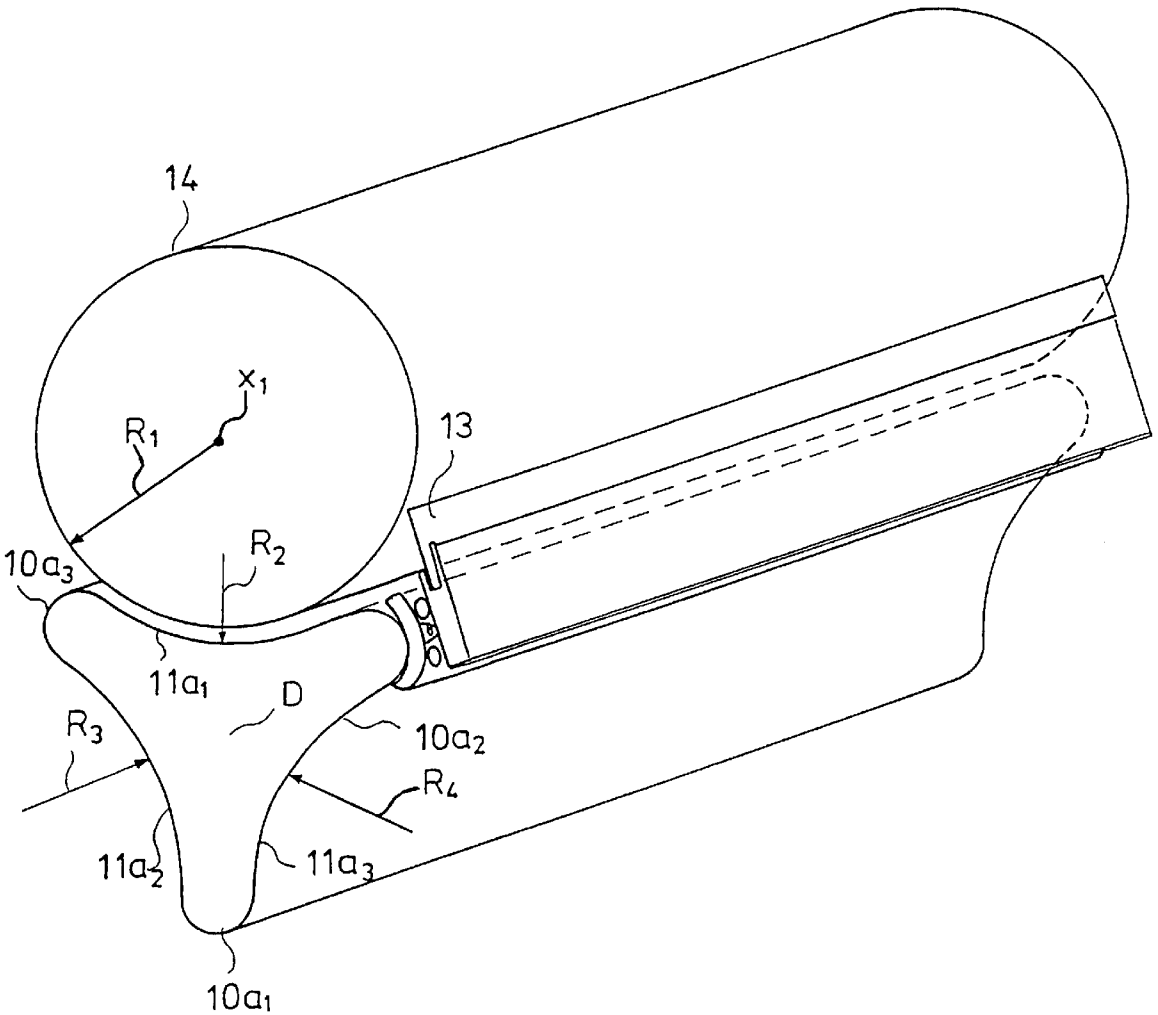
FIG. 2 is an axonometric view of the doctor beam shown in FIG. 1.

Referring to FIGS. 1–3 wherein like reference numerals refer to the same or similar elements, the doctor beam in accordance with the invention will be described.

As seen in FIG. 1, the doctor beam 10 according to the present invention comprises an elongate beam having a generally triangular shape with three points $\mathbf{10}a_1$, $\mathbf{10}a_2$, and $\mathbf{10}a_3$. The point $\mathbf{10}a_1$ is structured and arranged to bear the entire weight of the beam, the point $\mathbf{10}a_2$ is structured and arranged to serve as an attachment part for a blade holder of the doctor beam, and the point $\mathbf{10}a_3$ serves as a structural part for providing the beam with overall stiffness. In accordance with the invention, at least the curvature of $R_2$ of a wall $\mathbf{11}a_1$, that is the wall of the doctor beam closest to the roll 14 being doctored, is selected so that curvature complies, that is conforms, with the curvature $R_1$ of the face an adjacent roller or cylinder 14 of a paper or board machine. In other words, the arc that is defined by the wall $\mathbf{11}a_1$ has substantially the same curvature as the arc defined by the circumference of cylinder 14. The center of curvature of the wall $\mathbf{11}a_1$ is situated outside the doctor beam close to the axis $X_1$ of the roll 14. The above described construction enables the doctor beam 10 to be placed in close proximity with adjacent cylinder 14, thereby reducing the amount of spaced consumed by the doctor beam and enabling the doctor beam to fit in locations where the use of a conventional doctor beam would not be feasible.

The faces of the other walls $\mathbf{11}a_2$, $\mathbf{11}a_3$ are also preferably curved, so that they curve towards the inner part of the doctor beam and towards the center D of the beam. This enables the doctor beam according to the present invention to be placed between adjacent rolls in a paper or board machine having a plurality of such cylinders or rolls. The curvatures of $R_3$ and $R_4$ are preferably selected such that they conform to the curvature of the faces of a second and third adjacent rolls of the plurality of rolls in the paper or board machine, respectively. In this manner, the doctor beam can easily be interposed between two adjacent rolls in the paper or board machine.

The radii of curvature $R_2$, $R_3$, $R_4$ of the faces $\mathbf{11}a_1$, $\mathbf{11}a_2$ and $\mathbf{11}a_3$ are about identical with one another and of the same order of magnitude as the radius $R_1$ of the roll 14 which is maintained by the doctor blade 13 and against which the doctor blade lies. The doctor blade is situated in the blade holder 12, and the blade holder 12 is attached by means of a so-called nose part, i.e. a rib part 11*b* to the doctor beam structure 10.

FIG. 2 is an axonometric view of the doctor beam structure 10 in accordance with the invention. The doctor beam is advantageously made of carbon fiber, of a carbon fiber composite, and thus is lightweight and, additionally, when it is shaped in accordance with the invention, it occupies as little space as possible in connection with the roll or the drying cylinder 14. Other material alternatives include, for example steel.

FIG. 3 shows a structural beam 10 in accordance with the invention in which the curved face portion 11$a_1$ includes in connection therewith a rib 11*b*, to which the blade holder 12 with its doctor blade 13 is attached.

I claim:

1. A doctor beam (10) fitted in connection with a roll or a cylinder (14) in a paper machine or a board machine, said doctor beam comprising at least one face portion (11$a_1$) whose shape is curved and which complies with the curvature of the face of the roll mantle of an adjacent roll (14), said doctor beam having three points (10$a_1$, 10$a_2$, 10$a_3$), one point (10$a_2$) being structured and arranged to act as a mounting means for a blade bolder (12) of a doctor (13), another point (10$a_1$) being structured and arranged to act as a structural part receiving the weight of the doctor beam (10), and a third point being structured and arranged (10$a_3$) to give strength to the doctor beam.

2. A doctor beam (10) fitted in connection with a roll or a cylinder (14) in a paper machine or a board machine, said doctor beam comprising at least one face portion (11$a_1$) whose shape is curved and which complies with the curvature of the face of the roll mantle of an adjacent roll (14), wherein the doctor beam comprises three faces (11$a_1$, 11$a_2$, 11$a_3$) which are curved towards the center (D) of the doctor beam (10), in which connection the centers of curvature of the faces are situated outside the doctor beam.

3. A doctor beam as claimed in claim 1, wherein the doctor beam (10) is made of a carbon fibre composite.

4. In a paper or board machine having a plurality of rolls, cylinders or equivalents a doctor beam for coupling a doctor blade to one of the plurality of rolls, cylinders or equivalents, said doctor beam comprising:

an elongate beam body comprising at least one curved face, said curved face conforming to a curvature of a first one of the plurality of rolls, cylinders or equivalents, said elongate body being arranged so that said at least one curved face is placed in proximity to said first cylinder, said elongate beam having three points (10$a_1$, 10$a_2$, 10$a_3$), one point (10$a_2$) being structured and arranged to act as a mounting means for a blade holder (12) of a doctor (13), another point (10$a_1$) being structured and arranged to act as a structural part receiving the weight of the doctor beam (10), and a third point being structured and arranged (10$a_3$) to give strength to the doctor beam.

5. The doctor beam according to claim 4, further comprising a second curved face conforming to a curvature of a second one of the plurality of rolls, cylinders or equivalents, and said elongated body being arranged so that said second curved face is placed in proximity to said second cylinder.

6. The doctor beam according to claim 5, wherein first cylinder is adjacent said cylinder and said elongate body is interposed between said first and second cylinders.

7. In a paper or board machine having a plurality of rolls, cylinders or equivalents a doctor beam for coupling a doctor blade to one of the plurality of rolls, cylinders or equivalents, said doctor beam comprising:

an elongate beam body comprising at least one curved face, said curved face conforming to a curvature of a first one of the plurality of rolls, cylinders or equivalents, said elongate body being arranged so that said at least one curved face is placed in proximity to said first cylinder, said elongate beam body having three faces (11$a_1$, 11$a_2$, 11$a_3$) which are curved towards the center (D) of the doctor beam (10), in which connection the centers of curvature of the faces are situated outside the doctor beam.

* * * * *